United States Patent [19]

Dines

[11] Patent Number: 4,627,550

[45] Date of Patent: Dec. 9, 1986

[54] CONTAINER WITH TAMPER-EVIDENT LID

[75] Inventor: Keith W. Dines, Grays, England

[73] Assignee: Dines Plastics Limited, Essex, England

[21] Appl. No.: 764,773

[22] Filed: Aug. 12, 1985

Related U.S. Application Data

[63] Continuation of Ser. No. 550,587, Nov. 10, 1983, abandoned.

[30] Foreign Application Priority Data

Nov. 12, 1982 [GB] United Kingdom ..... 8232326

[51] Int. Cl.[4] ..... B65D 41/16; B65D 41/18

[52] U.S. Cl. ..... 220/306; 220/94 A; 220/220

[58] Field of Search ..... 220/265, 266, 270, 306, 220/94 A; 215/100 A

[56] References Cited

U.S. PATENT DOCUMENTS

| | | | |
|---|---|---|---|
| 3,401,827 | 9/1968 | Messina | 220/94 A |
| 3,979,012 | 9/1976 | Arfert et al. . | |
| 4,037,748 | 7/1977 | Stubbs, Jr. | 220/270 |
| 4,422,559 | 12/1983 | Landis . | |
| 4,431,110 | 2/1984 | Roth | 220/270 |

FOREIGN PATENT DOCUMENTS

| | | |
|---|---|---|
| 529222 | 5/1939 | United Kingdom . |
| 1342970 | 4/1971 | United Kingdom . |
| 1350989 | 4/1971 | United Kingdom . |
| 1470585 | 3/1974 | United Kingdom . |
| 1478558 | 10/1974 | United Kingdom . |
| 1439109 | 12/1974 | United Kingdom . |
| 1569947 | 2/1977 | United Kingdom . |
| 2076379 | 4/1981 | United Kingdom . |

*Primary Examiner*—George T. Hall

*Attorney, Agent, or Firm*—Antonelli, Terry & Wands

[57] ABSTRACT

A container is provided with a lid which is releasably secured to it by means of interlocking beads and respectively on the container and a depending skirt of the lid. An annular flange which abuts and is flush with the skirt of the lid serves as a protecting member to make it difficult for the lid to be removed without making use of a tamper-evident facility provided on the upper surface of the lid. This facility consists of a pull ring integrally moulded with the lid and firmly attached to it adjacent the periphery of the lid. In its inactive position, prior to the first removal of the lid from the container, it is held by a number of frangible connection points in a recess provided in the lid. In order to remove the lid from the container, it is necessary to grip the pull ring and pull it upwards thereby breaking the connection points and providing a subsequent indication that the lid has been removed.

10 Claims, 5 Drawing Figures

CONTAINER WITH TAMPER-EVIDENT LID

This is a continuation of application Ser. No. 550,587 filed Nov. 10, 1983, now abandoned.

DESCRIPTION

The present invention relates to a lid for a container, more particularly to a lid having a tamper-evident facility so as to provide an indication when the lid has been removed from a container to which it is fitted.

Various types of lid and lid/container combinations are known which are intended to prevent unauthorised or accidental access to the contents of the container. One well known example is frequently used with bottled products where a plastics cap is integrally moulded with a retaining ring which retains it on the neck of the bottle, the two being initially interconnected by a tear-off ring which has to be torn off before the cap can be pivoted to its open position.

According to the first aspect of the present invention there is provided a lid for a container, the lid being a one piece structure and having a recess on the upper surface thereof and an integral release element secured in an inactive or stowed position in the recess by frangible means which will break on moving the release element out of the recess to an active position in which it can be used to pull the lid from the container without tearing the upper surface of the lid, in the stowed condition the periphery of the release element being surrounded by an inner peripheral wall of the recess.

A second aspect of the present invention provides a combination of a container and a lid releasably fitted thereto, the lid being in accordance with the first aspect of the invention, the arrangement being such that the lid cannot readily be removed from the container without moving the release element to its active position and so that on pulling of the release element to its active position, first the frangible means will break and then the lid can be pulled from the container.

Thus the breaking of the frangible means during the moving of the release element to its active position gives an indication that the lid has previously been removed and thereby provides a "tamper-evident" facility. The release element may be a ring, loop or tab of material or in any other suitable form to facilitate its being gripped by the user and used to pull the lid from the container. Conveniently, the release element is anchored to the remainder of the lid adjacent the periphery of the lid so as to remain firmly attached thereto after the frangible means has been broken. By placing the firm anchorage of the release element at the periphery of the lid, when the release element is pulled upwardly, this tends to lift one portion of the periphery of the lid and thereby initiate its release from the container.

The frangible means may comprise a number of individual connection points in the form of "teeth" or "pips" at which the release element is frangibly connected to the upper surface of the lid, the connection points being disposed along the length of the release element.

The release element may conveniently be of a shape generally corresponding to that of the recess as viewed from above, although it does not have to be.

The releasable fitting of the lid to the container, which may be achieved by means of interlocking snap-fit beads or ribs on the container and lid is preferably arranged so that it is difficult to move the lid from the container without making use of the release element. For this purpose, the lid may be provided with a depending skirt which covers the upper part of the side wall of the container, the container in turn being provided with an annular flange extending radially outwardly beyond substantially any part of the lid so as to obstruct access to the lower edge of the skirt to prevent the lid being levered from the container at the skirt. The flange will assist in preventing the lid being knocked upwardly from below and, if it is arranged so that its peripheral surface is flush with that of the skirt and so that there is either no gap or only a very small gap between the lower edge of the skirt and the protecting member, it will be difficult to prise the lid off by levering it at the skirt.

The invention will be further described, by way of non-limiting example with reference to the accompanying drawings in which.

Figure 1:
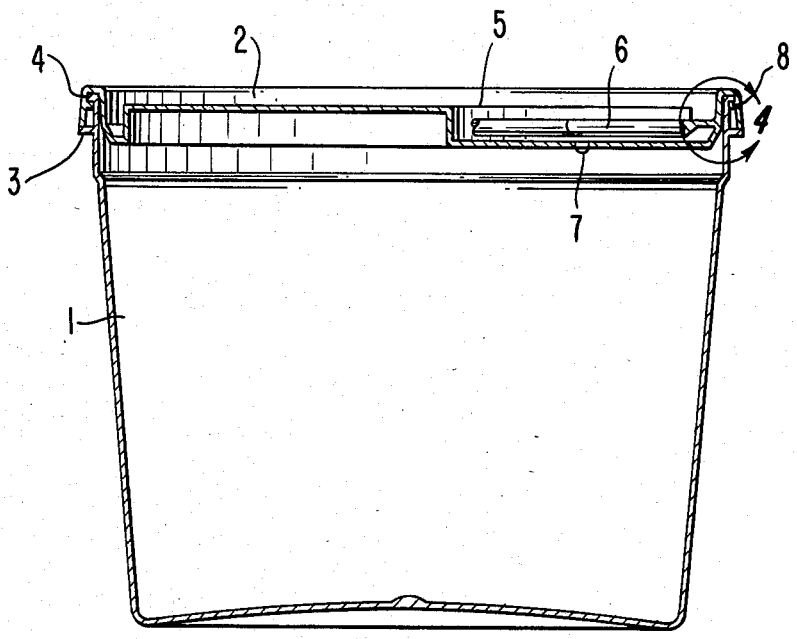
FIG. 1 is a cross-sectional view of one embodiment of container and lid according to the present invention.
Figure 2:
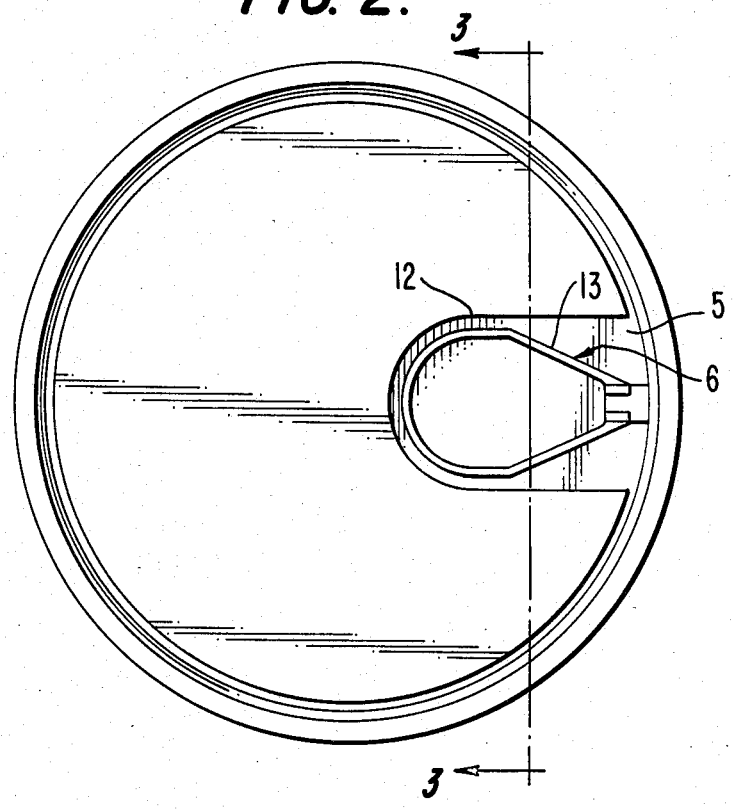
FIG. 2 is a plan view of the lid, also embodying the present invention, of the container and lid of FIG. 1.
Figure 3:
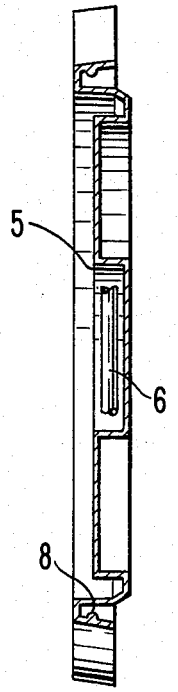
FIG. 3 is a cross-sectional view of the lid along the line 3—3 in FIG. 2.
Figure 4:
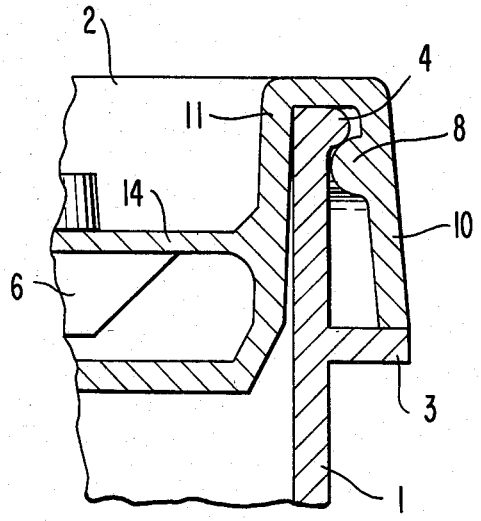
FIG. 4 shows to a larger scale the interlocking of the lid and container of FIG. 1.

FIG. 1 shows a container 1 and lid 2, both injection moulded of plastics material which are connected and sealed together by the interlocking of an outwardly projecting bead 4 at the upper edge of the rim of the container 1 and an inwardly projecting bead 8 on the inner periphery of a skirt 10 of the lid 2. This skirt 10 depends from an upstanding peripheral rim 11 of the lid which assists in locating the base of a container when a number of containers are stacked. The skirt 10 and rim 11 together defined an open-bottomed annular groove which receives the upper edge of the container wall. The provision of the groove and the respective beads on the inner and outer walls of the lid skirt and the container, respectively, gives easy location of the lid 2 onto the container 1 and a "lead" onto the wall of the container when fitting the lid 2 to it.

An annular flange 3 projects outwardly from the peripheral wall of the container 1, preferably at least approximately at right angles to it. This flange 3 is solidly connected to the container 1 around its entire circumference (there being no lines of weakening for the purpose of access to the container 1). The flange 3 preferably meets and touches or nearly touches the bottom edge of the outer skirt 10 of the lid 2 when the lid 2 is firmly sealed onto the container 1 and the flange 3 is preferably dimensioned so that its outer periphery is flush with that of the skirt 10 and the two thereby effectively form a continuous surface. This latter feature is intended to assist in preventing the lid to being prised off without use of the tamper-evident facility to be described below.

The flange 3 is so dimensioned in relation to the lid 2 that as viewed from below, the flange 3 completely covers the outer periphery of the lid 2 so that there is no part of the lid 2 accessible from below that might be used to prise off the lid. The flange 3 has thus a dual purpose, in that it prevents the accidental removal of a lid 2 in transist or handling when the jogging action of one container on another might otherwise cause the lid of one container to catch under the lower edge of the lid of another and lift it off and at the same time it makes the deliberate removal of the lid by merely pulling it off at the edge very difficult as mentioned above. The only easy way to remove the lid 2 and the most obvious way, is by using the ring-pull element 6.

In the top surface of the lid 2 is a recess or pocket 5 which is U-shaped as viewed in plan. Within this recess 5, spaced from the vertical wall of the recess but following the line of that wall is a narrow band of integrally moulded plastics material shown as a "ring-pull" element 6. This is conveniently, although not necessarily of the same general shape as the recess 5; in the example shown, its radially inner end 12 is U-shaped, corresponding to the shape of the recess 5, while its radially outer end reduces in width towards an integral flexible strip 14 which anchors it to the remainder of the lid and serves as a hinge when the release element is used. The release element 6 is thus effectively anchored to the lid at a single point, whereby the force exerted by pulling the release element during removal of the lid is concentrated on one area of the periphery of the lid, thereby facilitating the release of the lid. The element 6 is, prior to use, lightly attached to the top surface of the lid 2 along both of the parallel legs of the U by a series of a tear-off teeth or pips 7, these teeth or pips 7 each requiring an approximately equal force to break them so that when the element 6 is pulled up the line of breaking is led towards the rim of the lid. The recess 5 thus provides a pocket in which the element 6 normally fits so that no part of this element 6 comes into contact with another container base if containers are stacked one on top of the other. In addition, no part of the element 6 can be accidentally contacted and thus disturbed, by, for example, another container.

The container 1 and lid 2 are supplied separately to a filler or user. At this time the lid 2 has the tear off teeth 7 holding the element 6 in its seated position still in tact. After the container 1 has been filled with product, the lid 2 may be applied automatically and snapped firmly onto the container 1 by a downward force applied at the top outside edge of the lid 2. In this position, the skirt 10 of the lid 2 will meet or very nearly meet, as mentioned above, the annular flange 3 and this flange will completely cover the bottom edge of the lid 2.

In order to remove the lid 2 for the first time, the consumer lifts the part 12 of the ring pull element 6 with the tip of one finger. Further upward pulling will irrevocably tear the attaching teeth 7 which had previously held the element 6 parallel to the plane of the lid until the whole of the element is free from the lid apart from its firm anchorage points on the edge of the lid—the connection at this point should, of course, be sufficiently strong to enable the lid to be pulled from its engagement with the container 2 by further pulling force being applied to the element 6. At the stage at which all the teeth 7 have been torn, increased upward pulling lift the edge of the lid 2 from the container 1 and will generally "peel" the rest of the lid 2 from the container 1. It will be noted that pulling the element 6 to break the teeth 7 does not cause a hole to be torn in the container, which remains otherwise intact.

Having used the ring pull element 6 for the first time, in general, it will not naturally lie flat in its recess subsequently because of the stretch and curl imparted to plastics material. While therefore the ring pull element 6 will remain attached to the lid 2 throughout its life and may be used to remove the lid 2 on each occasion of use, it will, after the first use, be obvious that the lid 2 has been removed by this means. If then a consumer sees a container on a shop shelf where this ring pull element 6 has been disturbed, they will be immediately aware that access to the container has already been achieved. More generally, the use of the element 6 makes it very difficult to accidentally disturb the tamper evidence feature until a deliberate attempt is made to open the container.

Figure 5:
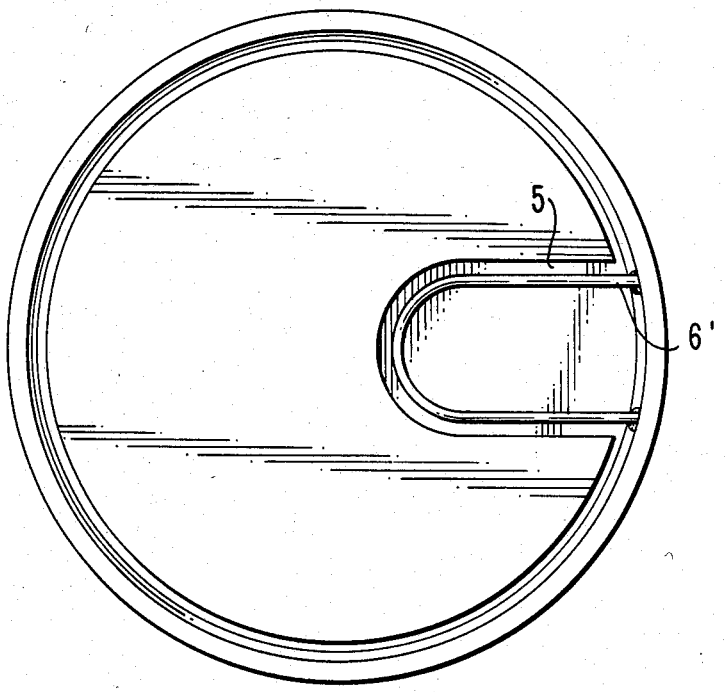
FIG. 5 is a view, corresponding to FIG. 1 and showing an alternative form of the release element.

It will be appreciated that althrough the element 6 has been shown as a hollow "pear" shaped band it can instead have any other suitable shape and might be solid rather than hollow so as to be more in the form of a tab than a ring. FIG. 5, shows a further version in which the element 6 is in the form of a hollow, U-shaped band.

I claim:

1. A tamper-evident lid for a container, the lid being molded as a one piece structure from plastic material and having, as integral parts thereof, a closure element, a securing arm and a release element having a tamper evident facility, the securing element being so arranged that the lid is removable only by using the release element to pull the lid from the container, wherein the closure element includes a recess defined on an upper surface thereof, the recess having an inner peripheral wall, the integral release element being secured in an inactive or stowed position in the recess by integrally molded frangible means so that the integral release element is surrounded by said inner peripheral wall and is located in the recess below the level of the upper surface of the closure element, the frangible means being of such a strength, in relation to that of the securing element, that pulling the release element sufficiently hard so as to pull the lid from the container will cause the release element to move out of the recess into an active position, and in so doing break off the frangible means thus providing a tamper evident facility, the release element then being usable to release the securing means and pull the lid from the container, the upper surface of the lid being unbroken by movement of the release element to the active position whereby the lid, once the frangible means have been broken, is reusable as a sealing lid for the container.

2. A lid according to claim 1 wherein the release element is anchored to the remainder of the lid adjacent the periphery of the lid so as to remain firmly attached thereto after the frangible means has been broken.

3. A lid according to claim 2, wherein the release element is anchored effectively at a single point on the periphery of the lid.

4. A lid according to claim 1 wherein the frangible means comprises a number of individual connection points of the release element to the upper surface of the lid, the connection points being disposed along the length of the release element.

5. A lid according to claim 1 wherein the release element is of generally a shape corresponding to that of the recess, as viewed from above and when in the inactive or stowed position, the release element is below the plane of the upper surface of the lid.

6. A lid according to claim 1 wherein the release element is in the form of a band or strip forming a closed loop or ring or in the form of a tab.

7. In combination, a container and a re-usable lid for the container, the lid being integrally molded from a plastic material as a one piece structure and having a recess defined on the upper surface thereof, the recess having an inner peripheral wall, and an integral release element secured in an inactive or stowed position in the recess by frangible means which will break on moving the release element out of the recess to an active position in which it can be used to pull the lid from the container without tearing the upper surface of the lid, in the stowed condition the periphery of the release element being surrounded by said inner peripheral wall of the recess, the arrangement being such that on pulling of the release element, first and frangible means will break and then the lid can be pulled from the container and be reused as a sealing lid for the container.

8. A combination according to claim 7, wherein the lid is releasably fitted to the container by means of interlocking rib or bead formations on the container and lid.

9. A combination according to claim 8, wherein the lid has a skirt and the formations are provided on the outer periphery of an upper part of the side wall of the container and on the inner periphery of the skirt.

10. A combination according to claim 9 wherein the container is provided with a protecting member in the form of a radially outwardly extending annular flange provided on the outer surface of its side wall at a location just below the skirt of the lid, the protecting member extending radially outwardly further than substantially any part of the skirt, the arrangement being such that the lower edge of the skirt abuts or is located closely adjacent the flange and the peripheral surface of the skirt is flush with that of the flange.

* * * * *